US010930454B2

(12) United States Patent
Benkert et al.

(10) Patent No.: US 10,930,454 B2
(45) Date of Patent: Feb. 23, 2021

(54) INSULATION ARRANGEMENT FOR A HIGH OR MEDIUM VOLTAGE ASSEMBLY

(71) Applicant: Siemens Aktiengesellschaft, München (DE)

(72) Inventors: Katrin Benkert, Schwaig (DE); Werner Hartmann, Weisendorf (DE); Martin Koletzko, Erlangen (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 0 days.

(21) Appl. No.: 16/481,689

(22) PCT Filed: Jan. 4, 2018

(86) PCT No.: PCT/EP2018/050166
§ 371 (c)(1),
(2) Date: Jul. 29, 2019

(87) PCT Pub. No.: WO2018/137903
PCT Pub. Date: Aug. 2, 2018

(65) Prior Publication Data

US 2020/0027673 A1 Jan. 23, 2020

(30) Foreign Application Priority Data

Jan. 27, 2017 (DE) ..... 10 2017 201 326.5

(51) Int. Cl.
*H01H 33/662* (2006.01)

(52) U.S. Cl.
CPC ..... *H01H 33/66207* (2013.01); *H01H 33/66261* (2013.01); *H01H 2033/66284* (2013.01); *H01H 2033/66292* (2013.01)

(58) Field of Classification Search
CPC ..... H01H 33/66207; H01H 33/66261; H01H 33/662; H01H 33/24; H01H 2033/6623;
(Continued)

(56) References Cited

U.S. PATENT DOCUMENTS 4,618,749 A * 10/1986 Bohme ..... H01H 33/66207 218/134
6,356,037 B1 * 3/2002 Sano ..... H01G 4/1227 315/241 R
6,891,122 B2 * 5/2005 Renz ..... H01H 33/66261 218/11
(Continued)

FOREIGN PATENT DOCUMENTS

CN 1808805 A 7/2006 ..... H02B 13/035
DE 241 809 A1 12/1986 ..... H01H 33/662
(Continued)

OTHER PUBLICATIONS

International Search Report and Written Opinion, Application No. PCT/EP2018/050166, 20 pages, dated Mar. 29, 2018.
(Continued)

*Primary Examiner* — William A Bolton
(74) *Attorney, Agent, or Firm* — Slayden Grubert Beard PLLC

(57) ABSTRACT

Various embodiments include an insulator arrangement for a high-voltage or medium-voltage assembly comprising an axially symmetrical insulating structure element having two annular base regions separated from one another by an annular blocking region. The relative permittivity of the material of the blocking region is at least twice as high as the relative permittivity of the material of the base region.

18 Claims, 3 Drawing Sheets

(58) Field of Classification Search
CPC ..... H01H 2033/66292; H01H 2033/66284; H01B 17/32
USPC ..... 218/139, 134, 136, 118; 174/50.5
See application file for complete search history.

(56) References Cited

U.S. PATENT DOCUMENTS

| | | | | |
|---|---|---|---|---|
| 9,123,490 | B2 * | 9/2015 | Baron | H01H 33/66261 |
| 2005/0230138 | A1 * | 10/2005 | Makino | H01H 33/66207 174/50.5 |
| 2006/0152890 | A1 | 7/2006 | Yokokura et al. | 361/605 |
| 2007/0007250 | A1 * | 1/2007 | Li | H01H 33/66207 218/134 |
| 2013/0062316 | A1 | 3/2013 | Renz et al. | 218/139 |

FOREIGN PATENT DOCUMENTS

| | | | | |
|---|---|---|---|---|
| DE | 10 2007 022 875 | A1 | 11/2008 | H01H 33/662 |
| DE | 10 2009 031 598 | A1 | 1/2011 | H01H 33/662 |
| FR | 2 971 884 | A1 | 8/2012 | H01H 33/04 |
| JP | 2005-285430 | A | 10/2005 | H01H 33/66 |
| JP | 2014-182877 | A | 9/2014 | H01H 33/662 |
| WO | 2014/187605 | A1 | 11/2014 | H01B 17/42 |
| WO | 2018/137903 | A1 | 8/2018 | H01H 33/662 |

OTHER PUBLICATIONS

Chinese Office Action, Application No. 201880008687.X, 10 pages, dated Sep. 1, 2020.

* cited by examiner

INSULATION ARRANGEMENT FOR A HIGH OR MEDIUM VOLTAGE ASSEMBLY

CROSS-REFERENCE TO RELATED APPLICATIONS

This application is a U.S. National Stage Application of International Application No. PCT/EP2018/050166 filed Jan. 4, 2018, which designates the United States of America, and claims priority to DE Application No. 10 2017 201 326.5 filed Jan. 27, 2017, the contents of which are hereby incorporated by reference in their entirety.

TECHNICAL FIELD

The present disclosure relates to insulation. Various embodiments include insulator arrangements for a high-voltage or medium-voltage assembly.

BACKGROUND

As insulator material in high- or medium-voltage assemblies, in particular switchgear assemblies, a ceramic material is often used as insulating material. The insulating capacity of these solid bodies is generally fairly high; defects in the lattice structure or grain structure of the ceramic materials can lead to a breakdown at high voltages, in particular higher than 72 kV. That is to say, the breakdown field strength $E_{bd}$ is reached starting from a critical electric voltage or a critical potential in the case of these materials.

However, the critical breakdown field strength $E_{bd}$ influenced by said defects cannot be increased only by way of the ceramic insulator being made correspondingly thicker or longer. The reason for this is that there is no linear increase in the breakdown field strength $E_{bd}$ due to an increase in the thickness or length of the insulator, but rather that there is a substantially square root relationship between the thickness or length of an insulator and its breakdown field strength. That is to say, a large increase in the thickness or length of the insulator can result in an only relatively small increase in the breakdown field strength. Therefore, owing to this square root relationship between thickness and breakdown field strength, the material expansion of the insulating material or of the insulating element would have to be increased in an overproportional manner in order to achieve a significant increase in the breakdown field strength. Although this is technically possible to a certain degree, it cannot be realized in an economical manner.

SUMMARY

Therefore, the teachings of the present disclosure describe insulator arrangements for a high-voltage or medium-voltage assembly, which insulator arrangement ensures an increase in the breakdown field strength of the insulator arrangement given constant geometric expansions in comparison to the prior art. For example, some embodiments include an insulator arrangement for a high-voltage or medium-voltage assembly (3) having at least one axially symmetrical insulating structure element (2), characterized in that the structure element (2) has at least two annular base regions (4) which are separated from one another by an annular blocking region (6), wherein the relative permittivity of the material of the blocking region (6) is at least twice as high as the relative permittivity of the material of the base region.

In some embodiments, the relative permittivity of the material of the blocking region (6) is at least five times, in particular ten times, in particular 100 times, as high as the relative permittivity of the base region (4).

In some embodiments, the material of the blocking region (6) comprises a titanate, in particular barium titanate.

In some embodiments, the material of the base region (4) has a relative permittivity which lies between 5 and 25.

In some embodiments, the relative permittivity of the material of the blocking region (6) is between 10 and 10,000, in particular between 100 and 10,000, in particular between 1000 and 10,000.

In some embodiments, the length expansion (8) of the base regions (4) in the direction of the axis of symmetry (10) is between 5 mm and 50 mm.

In some embodiments, the length expansion (12) of the blocking region (6) in the direction of the axis of symmetry (10) is between 0.1 mm and 5 mm.

In some embodiments, the ratio of the length expansion (8) of a respective base region to the respective length expansion (12) of the blocking region (6) arranged therebetween is between 10 and 100.

In some embodiments, the high-voltage or medium-voltage assembly (3) is a switchgear assembly.

In some embodiments, shielding elements (14) are fitted on an inner wall (28) of the structure element (2).

In some embodiments, the shielding elements (14) are arranged in or on a blocking region (6).

BRIEF DESCRIPTION OF THE DRAWINGS

Further embodiments and further features of the teachings herein are explained in more detail with reference to the following figures. They are exemplary embodiments which do not restrict the scope of the disclosure. In the drawings:

FIG. 4 shows a halved cross section through a structure element according to FIG. 2 with equipotential lines drawn in.

DETAILED DESCRIPTION

Figure 1:
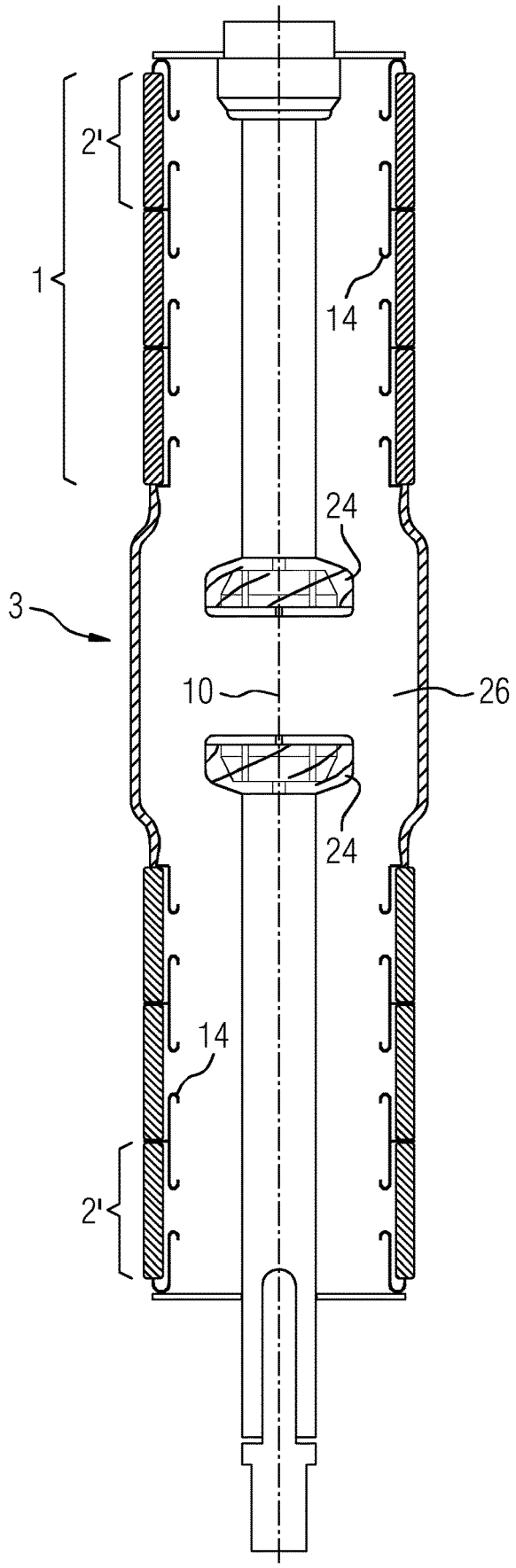
FIG. 1 shows a high-voltage switchgear assembly comprising an insulator arrangement according to the prior art.

In some embodiments, an insulator arrangement for a high-voltage or medium-voltage assembly has at least one structure element which is of axially symmetrical configuration. A typical symmetrical configuration of the structure element would be a cylindrical shape which, however, can also run conically; an elliptical distortion of the cross section is also technically possible in principle. In some embodiments, the structure element has at least two annular base regions which are separated from one another by a likewise annular blocking region. Here, annular is understood to mean a cylindrical shape which can equally run conically or in the form of a hollow cone and which has a round or elliptical cross section. In some embodiments, the permittivity of the material of the blocking region is at least twice as high as the permittivity of the material of the base region.

Owing to the insertion of blocking regions or at least one blocking region between two base regions of the insulator arrangement with a considerable increase in the permittivity of the blocking region in relation to the base region by at least a factor of 2, the electric field strength of the electric field which is induced by the high-voltage assembly is considerably reduced in the blocking regions in comparison to the base regions. These are referred to as weak-field regions; they are ideally field-free regions. This field attenuation is determined by the ratio of the relative permittivity of the material of the base regions and the relative permittivity of the blocking regions. In this way, the ceramic is internally subdivided in electrical terms into short axial pieces, as a result of which the dielectric strength of the section and also of the entire insulator arrangement is greatly increased.

Here, the permittivity $\varepsilon$, which is also called the electrical conductivity or the electrical function, is understood to be the permeability of a material to electric fields. The vacuum also has a permittivity which is also referred to as the electric field constant $\varepsilon_0$. The relative permittivity $\varepsilon_r$ of a substance is given here by the ratio of its actual permittivity 2 to the electric field constant $\varepsilon_0$:

$$\varepsilon_r=\varepsilon/\varepsilon_0. \qquad \text{Equation 1.}$$

In the text which follows, the permittivity mentioned is in each case the relative permittivity $\varepsilon_r$ as described in equation 1.

Owing to a difference by a factor of 2 between the relative permittivities of the base region and of the blocking region, a significant weakening of the electric field can already be observed in the blocking regions. However, in principle, the attenuation of the electric field in the blocking regions and therefore the resulting segmentation of the base regions into regions which are electrically decoupled from one another has a greater effect the higher the relative permittivity in the blocking regions, that is to say the higher the factor between the permittivity of the blocking region and the permittivity of the base region. In this case, it has been found that it is more advantageous if the relative permittivity of the blocking region is at least five times as high as the permittivity of the base region. In some embodiments, it is at least ten times or at least 100 times as high as the permittivity of the base region.

A permittivity which is as high as this can be achieved, in particular, by a titanate, that is to say a salt of titanic acid, in particular the barium titanate. In this case, an example combination is, as material for the base region, an aluminum oxide or a material which comprises aluminum oxide and, for the blocking region, a material based on a titanate, in particular barium titanate or calcium titanate. Titanium oxide also has a high permittivity and is suitable as a material or as a constituent material of the blocking region.

In some embodiments, the relative permittivity of the material of the base region lies between 5 and 25. In this case, the relative permittivity is a unit-free variable which, as mentioned, is made up of the ratio of the total permittivity and the electric field constant $\varepsilon_0$. The relative permittivity of the material of the blocking region is in contrast at least twice as high as the relative permittivity of the base region, that is to say at least has a magnitude of 10 and is found in a range of between 10 and 10,000. The relative permittivity of the control region may be in a range of between 100 and 10,000, and/or between 1000 and 10,000.

In some embodiments, the length expansion of the base regions in the direction of the axis of symmetry to amount to between a value of 5 mm and 50 mm. It has been found that particularly good segmentation of the insulator arrangement or of the structure element is found in these length ranges of the base regions. This is also true of a length expansion of the blocking regions which is between 0.1 mm and 5 mm. In some embodiments, the ratio of the length expansion of a respective base region to a respective length expansion of the associated blocking region may have a magnitude of between 10 and 100.

In some embodiments, the described insulator arrangement may be a constituent part of a high-voltage or medium-voltage switchgear assembly, wherein said switchgear assembly may be both a vacuum switchgear assembly and a gas-insulated switchgear assembly.

In some embodiments, shielding elements are fitted on an inner wall of the insulating structure element, which shielding elements serve to deflect and dissipate the electric field and to more homogeneously distribute the equipotential lines in the material of the structure element. These shielding elements, or also called shielding plates, may be arranged such that they are fastened in the structure element at points where there is a blocking region. In this case, equipotential lines are understood to mean lines with the same electric potential. They are perpendicular to corresponding field lines of the associated electric field and have a comparable density. Closely running equipotential lines correspond to close field lines, and equally equipotential lines which are pulled apart lead to field lines which are pulled apart.

FIG. 1 provides an illustration of a high-voltage switchgear assembly 3 which has a switching area 26 in which two switching contacts 24 are illustrated such that they can move axially in relation to one another, wherein electrical contact can be established and, respectively, broken by an axial movement of at least one of the switching contacts. Furthermore, the switchgear assembly 3 has insulator arrangements 1 which comprise at least one insulating structure element 2. In the case of the switchgear assembly according to FIG. 1 illustrated here, the insulator arrangement 1 has three structure elements 2.

However, the insulator arrangement 1 consists as far as possible only of one structure element 2. The possible way of realizing this will be discussed in more detail in the text which follows. In the case of an insulator arrangement 1 according to the prior art, a plurality of structure elements, which consist of an oxide ceramic, for example aluminum oxide ceramic, in particular, are generally combined by an appropriate joining method to form the overall insulator arrangement 1. By way of joining a plurality of conventional structure elements, it is possible to achieve segmentation which, in turn, leads to a higher breakdown field strength and therefore to a stronger voltage increase. In this case, the length of the insulator arrangement 1 in its axial direction is determined, in particular, by its breakdown field strength or its maximum insulatable voltage.

Figure 2:
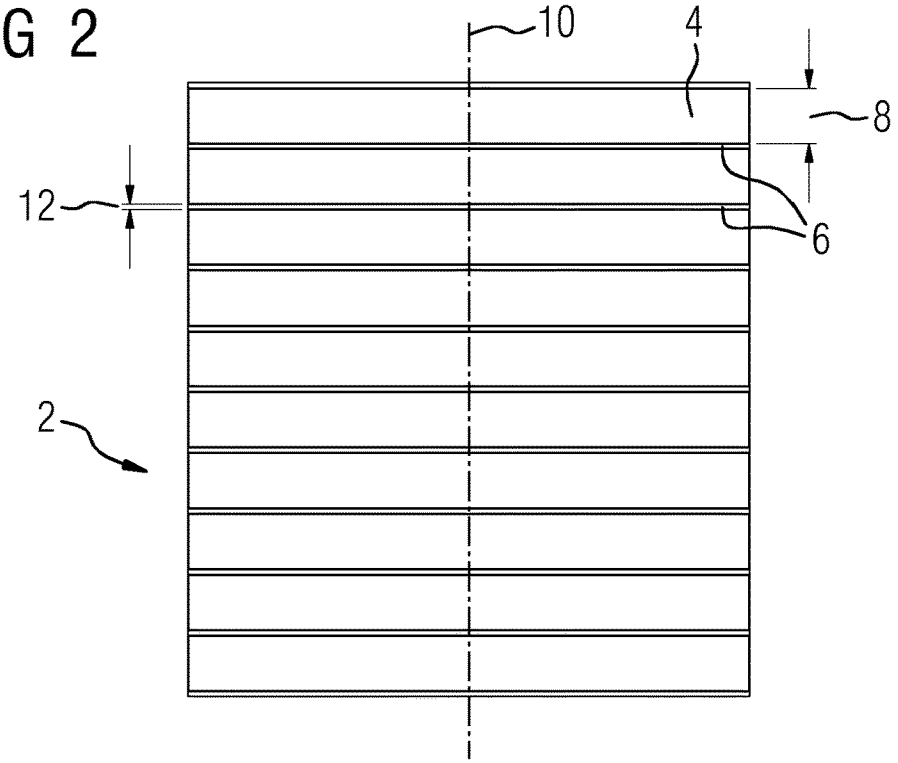
FIG. 2 shows a projected view of an insulating structure element with base regions and blocking regions, incorporating teachings of the present disclosure.
Figure 3:
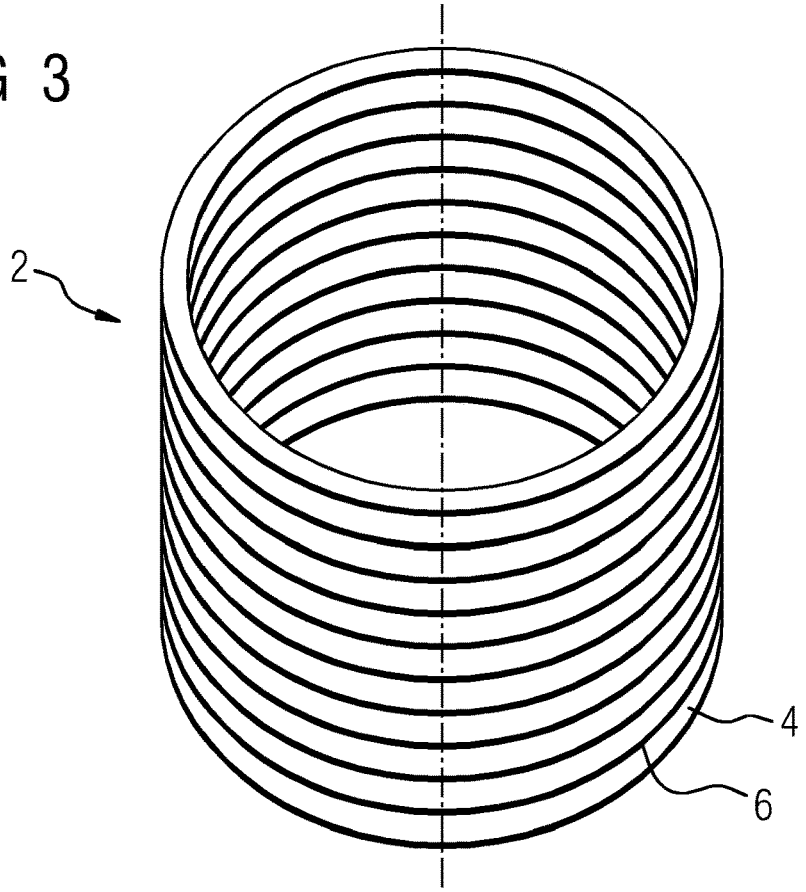
FIG. 3 shows a three-dimensional plan view of the structure element according to FIG. 2.
Figure 4:
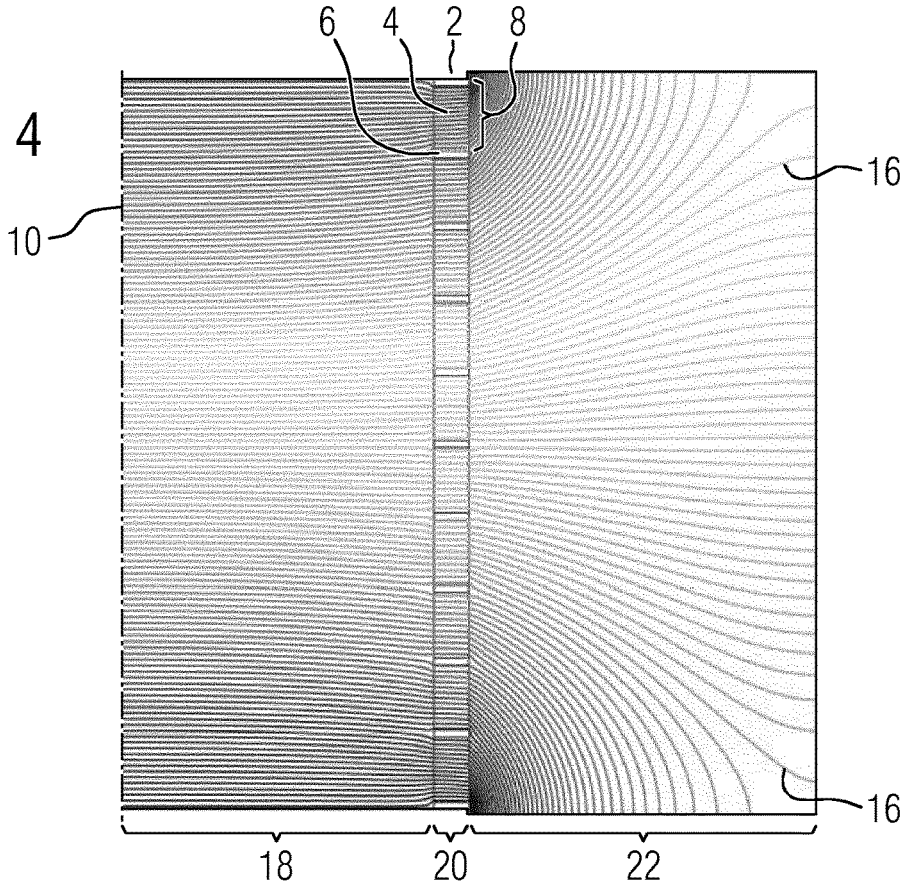
Figure 5:
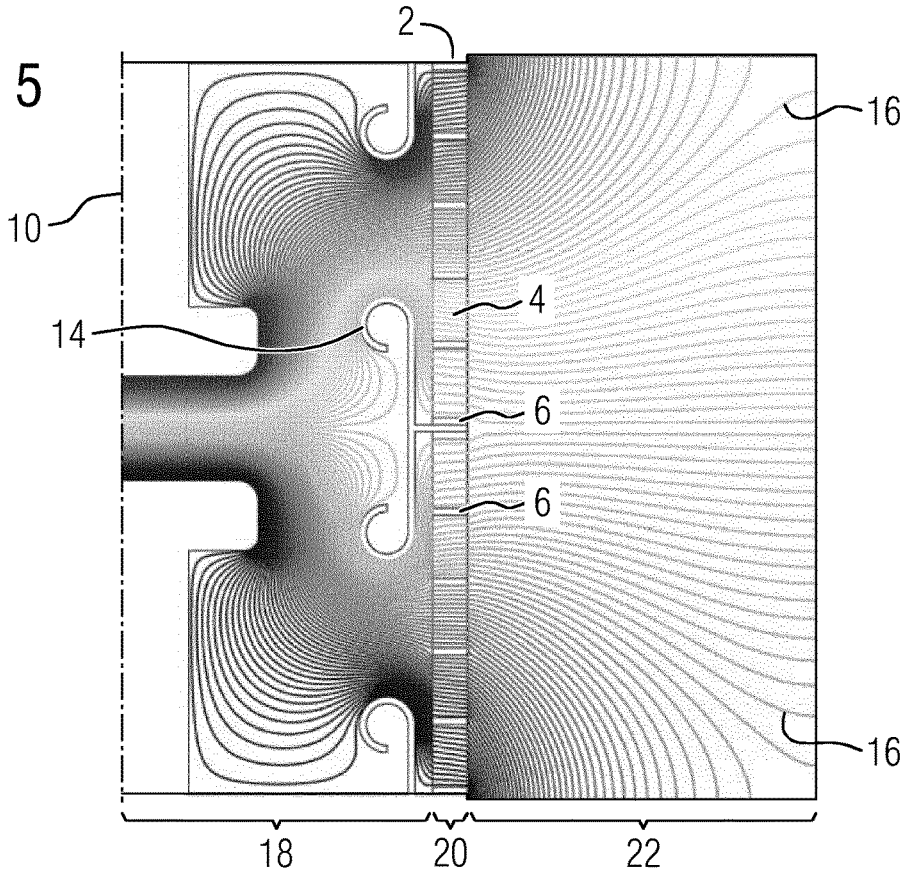
FIG. 5 shows an analogous illustration to FIG. 4, but with additional shielding elements.

FIG. 2 illustrates a structure element 2 which has both base regions 4 and blocking regions 6. In this case, the base regions 4 have an axial length expansion 8 which is greater than an axial length expansion 12 of the blocking regions 6. Two base regions 4 are separated from one another by one blocking region 6 in each case. The axial expansion is described along the rotation axis 10 in each case. The same insulating structure element 2 from FIG. 2 is shown in a three-dimensional illustration in FIG. 3 for improved clarity. FIGS. 4 and 5 each show the equipotential line profile of equipotential lines 16 of an electric field which is induced by the electric current flow present in the switching area 26. In this case, only the right-hand half of the cross section of the structure element 2 is illustrated. The axis of symmetry 10 is found on the left-hand outer edge, and a section through the base regions 4 and through the blocking regions 6 is shown in the middle of the illustration according to FIG. 4 and also according to FIG. 5. In this case, FIGS. 4 and 5 are each subdivided into a region 18 within the structure element on the left-hand side of the image and into a region 22 outside the structure element and also into a region 20 which illustrates the section through the material of the structure element.

Starting from the axis of symmetry 10, a homogeneous electric field, which is described by the equipotential lines 16, is illustrated. The homogeneity of the field in the region 18 is shown by the relatively uniform distance between the equipotential lines 16. In contrast, the equipotential line profile is very different in the region 22 outside the structure element 2, with regions with a high equipotential line density, in which regions a strong electric field strength prevails, and a region with equipotential lines 16 which are pulled far apart, in which region a weaker electric field is present, being present in said region 22.

It is noticeable that there are virtually no equipotential lines 16 present in the blocking regions 6, which means that an extremely weak or, ideally, no electric field prevails in the blocking regions 6. This in turn leads to electrical segmentation of the insulating structure element, that is to say of the ceramic insulator, being generated by the blocking regions 6. The base regions 4 therefore act as further subordinate insulating structure elements which are electrically isolated from their neighboring base region, specifically by the blocking region 6.

An analogous illustration to this is provided in FIG. 5, wherein the equipotential lines virtually do not appear in the blocking regions 6 here either and therefore the described segmentation between base regions is achieved. However, FIG. 5 also shows further shielding elements 14 which are also called shielding plates 14 and create deliberate and optimized guidance of the equipotential lines 16. Corresponding shielding elements 14 are also correspondingly illustrated in FIG. 1. The shielding elements 14 are preferably configured such that they are anchored in blocking regions 6 in the structure element 2.

The reduction in the equipotential lines 16 or of the electric field 16 illustrated in such a way in the blocking regions 6 of the structure element 2 is achieved by way of the material of the blocking regions 6 having a relative permittivity which is at least twice as high as the relative permittivity of the base regions 4. In this way, the electric field is virtually pushed out of the blocking regions 6. This in turn causes electrical segmentation of the structure element 2 into the base regions 4. This in turn has a similar effect on the breakdown field strength to joining a plurality of structure elements, as is illustrated in FIG. 1 by the designation 2' for the structure element.

Joining of structure elements 2 to form an insulator arrangement 1 is not desirable in principle since this involves costly working processes which require quality assurance and a high level of technical expenditure in order to ensure vacuum tightness or gas tightness. Therefore, by using to the described arrangement of the structure element 2 and the segmentation into base regions 4 and also into blocking regions 6, it is possible to configure the entire insulator arrangement 1 of a switchgear assembly 3 or generally of a high-voltage or medium-voltage assembly 3 using just one insulating structure element 2. Although this is technically adequate, it also depends on the required overall breakdown field strength or the maximum applied voltage. For example, high-voltage switchgear assemblies of 72 kV can be realized by a structure element 2 with a length expansion in an axial orientation of 80 mm or less.

Using the conventional described technology, two to three structure elements would have to be joined to one another by a joining method for this purpose. In summary, it should be stated that an insulator arrangement 1 should comprise, as far as possible, only one structure element 2, but two or more structure elements 2 can also be joined to form an insulator arrangement 1 in the case of high-voltage assemblies with a very high voltage, wherein said insulator arrangement then has an overall length expansion which is considerably lower than the length expansion of conventionally equipped structure elements according to the prior art without the described segmentation.

In some embodiments, when producing the structure element 2, materials for the base regions 4 and materials for the blocking regions 6 can be introduced alternately into a press mold and can already be pressed into this structure and sintered. That is to say, owing to a conventional working step by introducing the materials alternately into the appropriate mold, a segmented structure element 2 can be produced, which has a breakdown field strength and a strength which, according to conventional means, can be achieved only with structure elements which are connected to one another by complicated soldering methods or joining methods. In this way, the production costs for the insulator arrangement can be considerably reduced and the claimed length expansion and therefore the assembly space for the switchgear assembly and the external dimensioning of the switchgear assembly can be reduced.

What is claimed is:

1. An insulator arrangement for a high-voltage or medium-voltage assembly, the insulator arrangement comprising:

an axially symmetrical insulating structure element having two annular base regions separated from one another by an annular blocking region;

wherein a first relative permittivity of a first material of the blocking region is at least twice as high as a second relative permittivity of a second material of the two base regions;

wherein a length of the blocking region measured along an axis of symmetry is between 0.1 mm and 5 mm.

2. The insulator arrangement as claimed in claim 1, wherein the first relative permittivity of the first material is at least five times as high as the second relative permittivity.

3. The insulator arrangement as claimed in claim 1, wherein the first material comprises a titanate.

4. The insulator arrangement as claimed in claim 1, wherein the second relative permittivity lies between 5 and 25.

5. The insulator arrangement as claimed in claim 1, wherein the first relative permittivity is between 10 and 10,000.

6. The insulator arrangement as claimed in claim 1, wherein a ratio of a length of a respective base region to a length of the blocking region arranged therebetween is between 10 and 100.

7. The insulator arrangement as claimed in claim 1, further comprising a switchgear assembly.

8. The insulator arrangement as claimed in claim 7, further comprising shielding elements fitted on an inner wall of the structure element.

9. The insulator arrangement as claimed in claim 8, wherein the shielding elements are arranged in or on the blocking region.

10. An insulator arrangement for a high-voltage or medium-voltage assembly, the insulator arrangement comprising:

an axially symmetrical insulating structure element having two annular base regions separated from one another by an annular blocking region;

wherein a first relative permittivity of a first material of the blocking region is at least twice as high as a second relative permittivity of a second material of the two base regions;

wherein a ratio of a length of a respective base region to a length of the blocking region is between 10 and 100.

11. The insulator arrangement as claimed in claim 10, wherein the first relative permittivity of the first material is at least five times as high as the second relative permittivity.

12. The insulator arrangement as claimed in claim 10, wherein the first material comprises a titanate.

13. The insulator arrangement as claimed in claim 10, wherein the second relative permittivity lies between 5 and 25.

14. The insulator arrangement as claimed in claim 10, wherein the first relative permittivity is between 10 and 10,000.

15. The insulator arrangement as claimed in claim 10, wherein a length of the blocking region measured along an axis of symmetry is between 0.1 mm and 5 mm.

16. The insulator arrangement as claimed in claim 10, further comprising a switchgear assembly.

17. The insulator arrangement as claimed in claim 16, further comprising shielding elements fitted on an inner wall of the structure element.

18. The insulator arrangement as claimed in claim 17, wherein the shielding elements are arranged in or on the blocking region.

* * * * *